US006039660A

United States Patent [19]

Kasashima et al.

[11] Patent Number: 6,039,660

[45] Date of Patent: Mar. 21, 2000

[54] GOLF BALL

[75] Inventors: Atsuki Kasashima; Keisuke Ihara; Hirotaka Shimosaka, all of Chichibu, Japan

[73] Assignee: Bridgestone Sports Co., Ltd., Tokyo, Japan

[21] Appl. No.: 09/132,779

[22] Filed: Aug. 12, 1998

[30] Foreign Application Priority Data

Aug. 15, 1997 [JP] Japan ..... 9-235389

[51] Int. Cl.[7] ..... A63B 37/14; A63B 37/02

[52] U.S. Cl. ..... 473/378; 473/384

[58] Field of Search ..... 473/384, 383, 473/378, 379, 380, 381, 382

[56] References Cited

U.S. PATENT DOCUMENTS 4,681,323 7/1987 Alaki et al. ..... 473/384
5,024,444 6/1991 Yamagishi et al. .
5,503,397 4/1996 Molitor et al. .
5,544,889 8/1996 Moon .
5,735,757 4/1998 Moriyama .
5,782,702 7/1998 Yamagishi et al. .
5,842,937 12/1998 Dalton et al. ..... 473/384
5,911,639 6/1999 Kasashima et al. .

*Primary Examiner*—William M. Pierce
*Attorney, Agent, or Firm*—Sughrue, Mion, Zinn Macpeak & Seas, PLLC

[57] ABSTRACT

In a golf ball having a multiplicity of dimples of circular plane shape on its surface, the dimples include plural types of dimples having different diameters. The dimples of at least one type are formed to at least two different cross-sectional shapes. A three-dimensionally appropriate combination and arrangement of a multiplicity of dimples on the ball surface is effective for improving the aerodynamic behavior of the golf ball so that the ball exerts excellent flight performance.

10 Claims, 4 Drawing Sheets

GOLF BALL

This invention relates to a golf ball having improved flight performance.

BACKGROUND OF THE INVENTION

In general, golf balls are provided with a multiplicity of dimples of circular plane shape on their surface for the purpose of improving their aerodynamic properties. It is well known that the dimpled golf balls are far better in flight behavior than smooth golf balls free of dimples.

The flight distance of golf balls depends on the initial velocity, drag and lift acting on the ball during flight, spin rate, and other factors such as weather conditions. It is considered difficult to make a theoretical analysis on golf balls with the aim of increasing their flight distance.

For improving the flight performance of the ball except for the initial velocity which is largely governed by the material of the ball, a number of attempts of tailoring dimples relating to the geometrical factors of the ball have been made. Such attempts include, for example, increasing the diameter of dimples, using plural types of dimples having different diameters, increasing or decreasing the depth of dimples, changing the shape of dimples from circular one to polygonal and other shapes, and increasing or decreasing the number of dimples. More or less fruitful results are obtained from these attempts.

There is still a demand to develop golf balls whose flight performance is satisfactory for the high skill level of professional and equivalent golfers.

SUMMARY OF THE INVENTION

An object of the invention is to provide a golf ball having dimples on its surface, wherein aerodynamic properties are improved by arranging dimples of different shapes in a three-dimensional combination.

According to the invention, there is provided a golf ball having a multiplicity of dimples of circular plane shape on its surface. The dimples include plural types of dimples having different diameters. The dimples of at least one type have at least two different cross-sectional shapes.

In one preferred embodiment, for the dimples of at least one type having at least two different cross-sectional shapes, the difference in $V_0$ between the dimples of different cross-sectional shapes is at least 0.03. $V_0$ is the volume of space in a dimple below a planar surface circumscribed by the edge of the dimple divided by the volume of a cylinder whose base is the planar surface and whose height is the maximum depth of the dimple from this base.

In a further preferred embodiment, an average of $V_0$ values of all the dimples on the ball surface is in the range of 0.4 to 0.6.

According to the invention, the golf ball possesses on its surface plural types of dimples having different diameters, one type consists of dimples which are equal in diameter, but different in cross-sectional shape, and preferably, the difference in $V_0$ between the dimples of different cross-sectional shapes is at least 0.03. The dimple shapes are then optimized from a three-dimensional view. An arrangement of these dimples in an appropriate combination permits the dimples to exert their aerodynamic effect to a full extent, achieving a drastic improvement in aerodynamic properties. There is obtained a golf ball having improved flight performance.

DETAILED DESCRIPTION OF THE INVENTION

The golf ball G of the invention has a multiplicity of dimples 1 of circular plane shape on its surface. The dimples include plural types of dimples a, b which are different in diameter. Among the plural types of dimples having different diameters, the dimples of at least one type are formed to at least two different cross-sectional shapes a, a'.

The dimples 1 are circular in plane shape and preferably, have a diameter in the range of 2 to 5 mm and a depth in the range of 0.05 to 0.30 mm. There are plural types, typically two to five types of dimples in which the diameter or the diameter and depth are different within these ranges.

Figure 1:
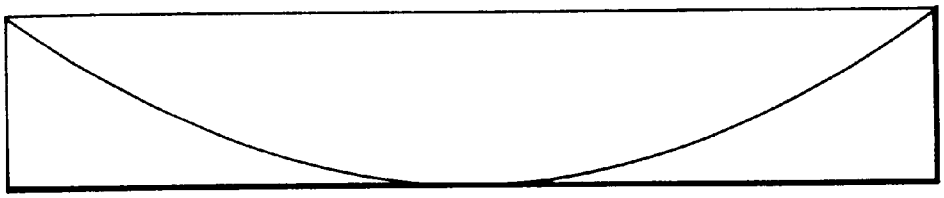
FIG. 1 is a cross-sectional view of a dimple in a golf ball, showing one cross-sectional shape of the dimple.
Figure 2:
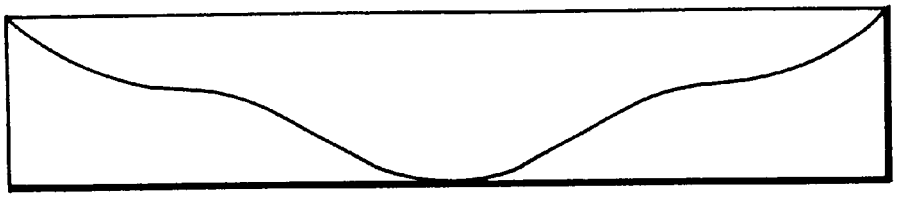
FIG. 2 is a cross-sectional view of a dimple having another cross-sectional shape.
Figure 3:
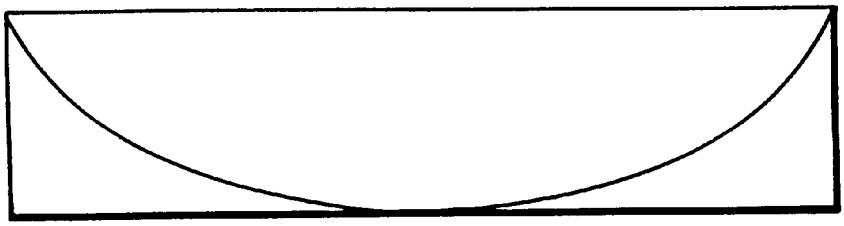
FIG. 3 is a cross-sectional view of a dimple having a further cross-sectional shape.

For at least one type a among the plural types of dimples having different diameters, the dimples of that type consist of dimples having at least two, preferably two or three, different cross-sectional shapes a, a'. The cross-sectional shapes of dimples include an ordinary circular arc shape as shown in FIG. 1, a dual-dent shape consisting of a shallow concave peripheral portion and a deeply depressed central portion as shown in FIG. 2, and a semi-oval shape defining an arc deeply depressed from the dimple edge as shown in FIG. 3.

It is of course possible in the invention that for all the plural types of dimples having different diameters, the dimples of each type have at least two different cross-sectional shapes. However, most often, for only the group of dimples of one type accounting for the majority of the overall dimple number, dimples of different cross-sectional shapes may be employed, for example, dimples of the cross-sectional shapes of FIGS. 2 and 3 are employed. Alternatively, it is effective that the kind of dimple cross-sectional shape is varied in order from the group of dimples of one type accounting for a greater proportion of the overall dimple number. In the event wherein three types of dimples having different diameters are included, for example, a first type of dimples having a first diameter accounting for the greatest proportion of the overall dimple number consists of dimples of three different cross-sectional shapes, a second type of dimples having a second diameter accounting for the second greatest proportion consists of dimples of two different cross-sectional shapes, and a third type of dimples having a third diameter accounting for the lowest proportion consists of dimples of one cross-sectional shape.

$V_0$ defined below is useful as an index for evaluating the difference between the cross-sectional shapes of dimples. The dimple cross-sectional shape coefficient $V_0$ is the volume of space in a dimple below a planar surface circumscribed by the edge of the dimple divided by the volume of a cylinder whose base is the planar surface and whose height is the maximum depth of the dimple from this base.

Figure 5:
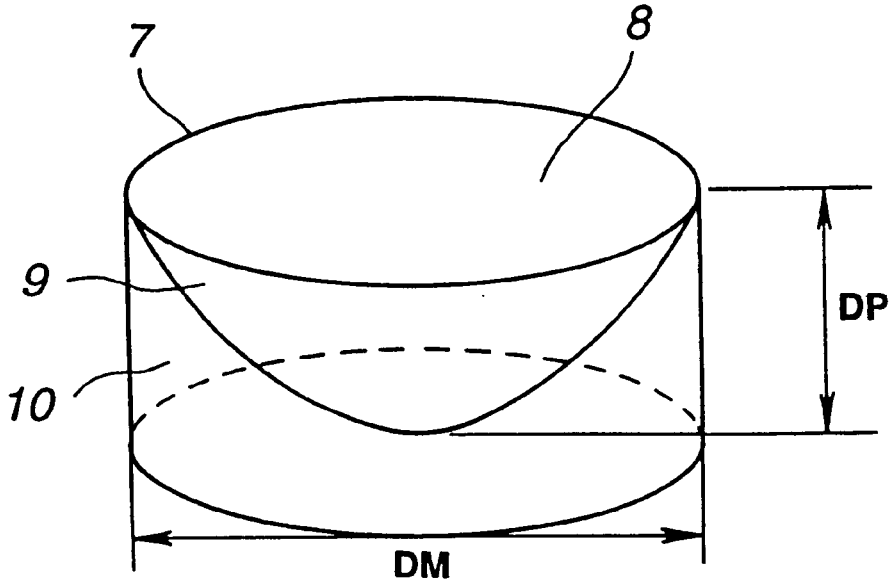
FIG. 5 is a perspective view of the same dimple as in FIG. 4.
Figure 6:
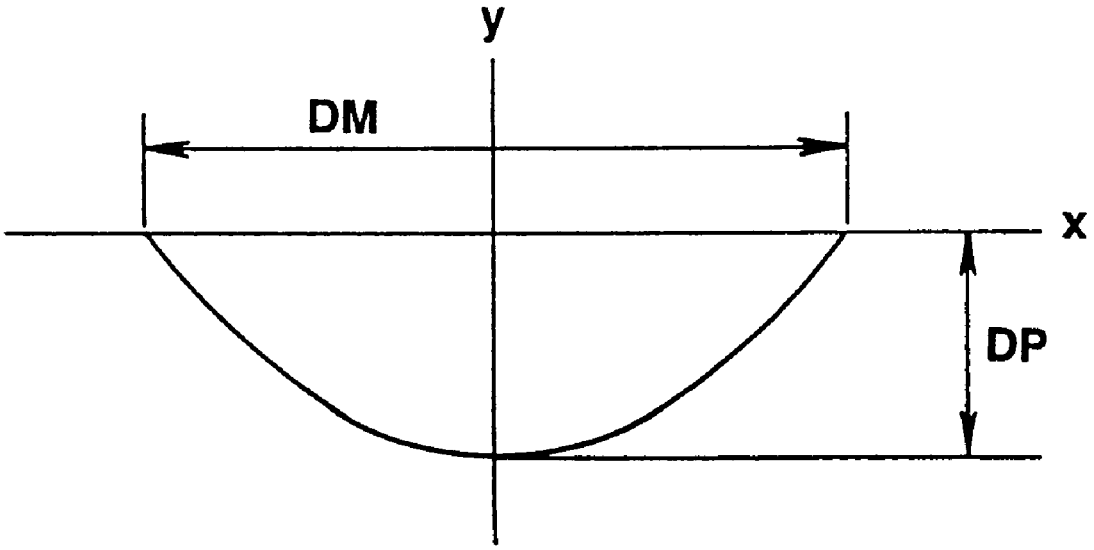
FIG. 6 is a cross-sectional view of the same dimple as in FIG. 4.

The value $V_0$ indicates the proportion of the volume that individual dimples essentially occupy on the golf ball. This value is described in greater detail. In the cross-section of FIG. 4, viewed radially with respect to the ball center, an imaginary sphere 2 having the diameter of the ball and an imaginary sphere 3 having a diameter 0.08 mm smaller than the ball diameter (or imaginary sphere having a radius 0.04 mm smaller than the ball radius) are drawn in conjunction with a dimple 1. The circumference of sphere 3 intersects the dimple 1 at two points 4. The tangents 5 to the dimple 1 at these points 4, extended outward, intersect imaginary sphere 2 at points 6. A series of such intersections 6 defines the dimple edge 7. The dimple edge 7 is defined for the reason that the exact position of the dimple edge cannot be otherwise determined because the actual edge of a dimple 1 is generally rounded. As shown in FIGS. 5 and 6, the dimple edge 7 circumscribes a planar surface 8 (a circle having a diameter DM). The dimple space 9 below this planar surface 8 has a volume Vp which is calculated using the equation shown below. A cylinder 10 whose base is the planar surface 8 and whose height is the maximum depth DP of the dimple from this planar surface 8 or base has a volume Vq which is calculated using the equation shown below. The $V_0$ value is obtained by calculating the ratio of the dimple space volume Vp to the cylinder volume Vq.

$$Vp = \int_0^{\frac{DM}{2}} 2\pi xy dx$$

$$Vq = \frac{\pi DM^2 DP}{4}$$

$$V_o = Vp / Vq$$

In the golf ball of the invention including plural types of dimples having different diameters, the dimples of at least one type having at least two different cross-sectional shapes should preferably have a difference in $V_0$ of at least 0.03 between a dimple of one cross-sectional shape and a dimple of another different cross-sectional shape. The upper limit of this difference is 0.2. A difference in $V_0$ of less than 0.03 indicates little or no substantial difference between dimple cross-sectional shapes, often failing to achieve the benefits of the invention.

Figure 4:
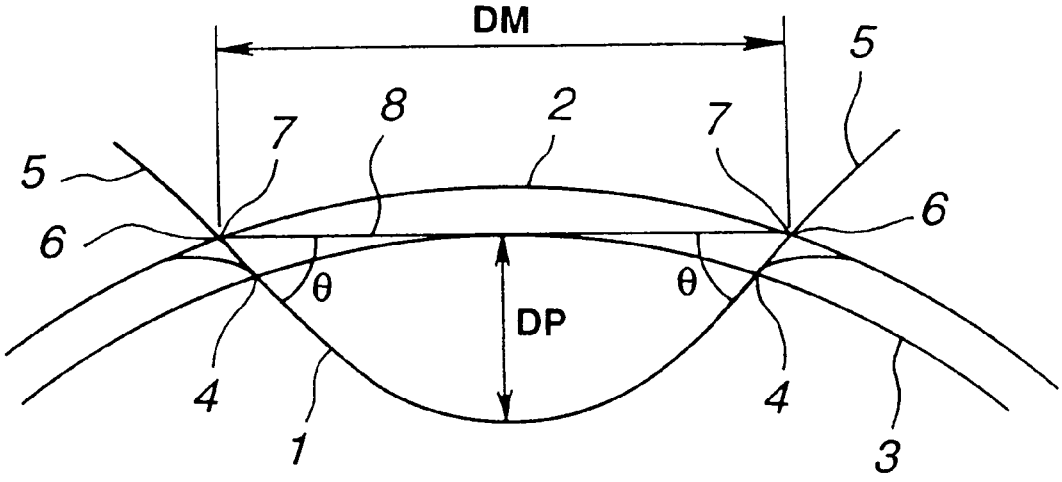
FIG. 4 is a schematic cross-sectional view of a dimple illustrating how to calculate $V_0$.

It is noted that θ in FIG. 4 is an edge angle which is the angle between tangent 5 at intersection 4 and planar surface 8 circumscribed by dimple edge 7. Typically, the edge angle θ is about 3° to about 30°.

The average of $V_0$ values for all the dimples on the ball surface should preferably fall in the range of 0.4 to 0.6, more preferably 0.43 to 0.55. For the golf ball of the invention wherein there are plural types of dimples which are different in diameter or diameter and depth, and the dimples of at least one type have at least two different cross-sectional shapes, the average $V_0$ value is determined by determining a $V_0$ value of each of dimples having different cross-sectional shapes in each dimple group, collecting the $V_0$ values in each dimple group, and averaging these values to give the average $V_0$ value for the entire dimples. The average $V_0$ value is in the range of 0.4 to 0.6, preferably 0.43 to 0.55. If the average $V_0$ value is less than 0.4 or more than 0.6, the balls tend to travel short.

In the golf ball of the invention, the arrangement of dimples on the ball surface is not critical and any of a number of well-known arrangements including regular octahedral and icosahedral arrangements may be used. The total number of dimples is usually from 300 to 500.

There has been described a golf ball having a multiplicity of dimples on its surface, wherein the dimples include plural types of dimples having different diameters, and the dimples belonging to one group having a certain diameter have at least two different cross-sectional shapes. An arrangement of the dimples in an appropriate three-dimensional combination permits the dimples to exert their aerodynamic effect to a full extent, achieving a drastic improvement in flight distance.

In the golf balls of the invention, no particular limits are imposed on the ball structure other than the above-described dimple structure. The balls may be prepared from well-known materials as solid golf balls including one-piece golf balls, two-piece golf balls and multi-piece golf balls having a three or more layer structure as well as wound golf balls.

EXAMPLE

Examples of the invention are given below by way of illustration and not by way of limitation.

Examples 1–2 and Comparative Example 1

Two-piece solid golf balls having a diameter of 42.7 mm and a weight of 45.2 g were prepared in a conventional manner using well-known materials.

Figure 7:
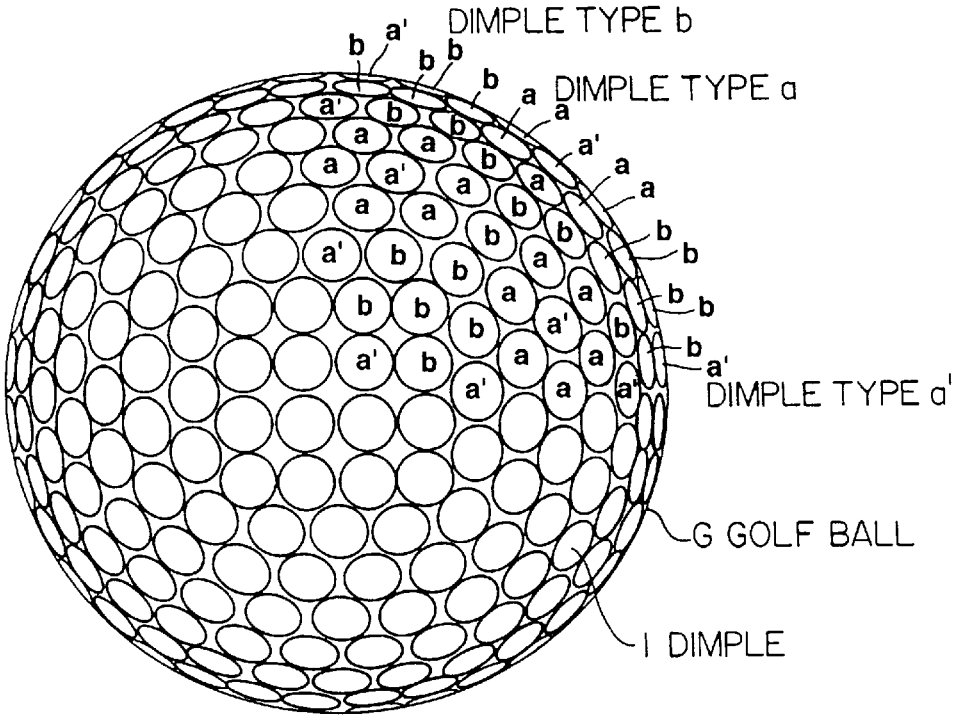
FIG. 7 illustrates an arrangement pattern of dimples on the golf ball of Example 1.

The golf ball of Example 1 had on its surface dimples of three types (a), (a') and (b) as shown in Table 1, which were distributed in a regular octahedral arrangement as shown in FIG. 7. Note that dimple types are labeled only in a quarter of the ball surface which is illustrated in FIG. 7. The average $V_0$ value for all the dimples was 0.46.

Figure 8:
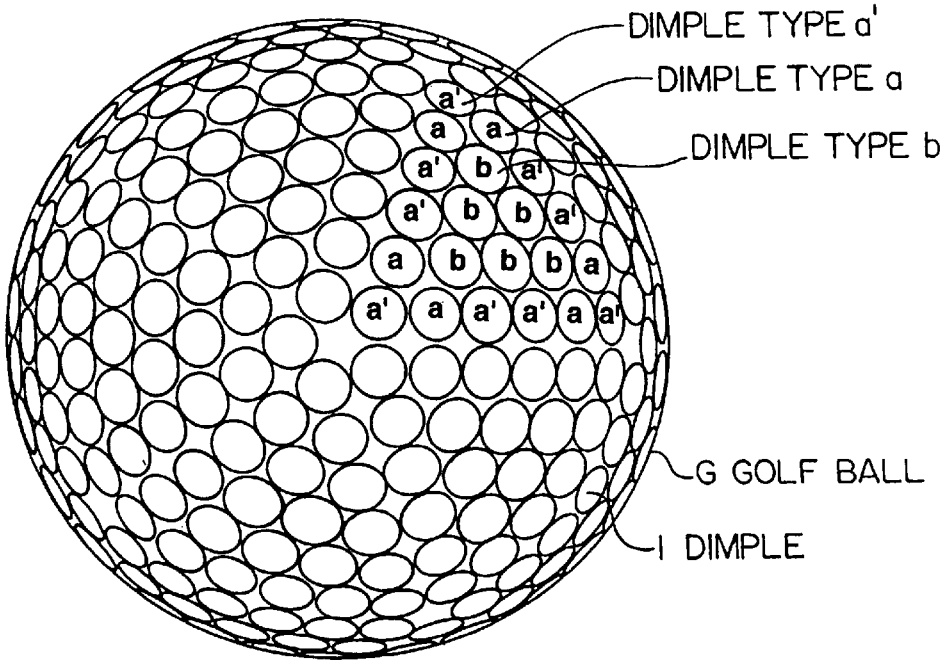
FIG. 8 illustrates an arrangement pattern of dimples on the golf ball of Example 2.

The golf ball of Example 2 had on its surface dimples of three types (a), (a') and (b) as shown in Table 2, which were distributed in a regular icosahedral arrangement as shown in FIG. 8. Note that dimple types are identified only in an approximately ⅕ portion of the ball surface which is seen in FIG. 8. The average $V_0$ value for all the dimples was 0.464.

The golf ball of Comparative Example 1 was the same as the ball of Example 1 except that dimples (a) were used instead of dimples (a'). That is, the ball had dimples of two types (a) and (b). The average $V_0$ value for all the dimples was 0.45.

TABLE 1

| | Diameter (mm) | Depth (mm) | $V_0$ | Cross-sectional shape |
|---|---|---|---|---|
| Dimple type (a) | 3.95 | 0.161 | 0.45 | FIG. 1 |
| Dimple type (a') | 3.95 | 0.153 | 0.5 | FIG. 2 |
| Dimple type (b) | 3.8 | 0.154 | 0.45 | FIG. 1 |

TABLE 2

| | Diameter (mm) | Depth (mm) | $V_0$ | Cross-sectional shape |
|---|---|---|---|---|
| Dimple type (a) | 3.60 | 0.152 | 0.46 | FIG. 1 |
| Dimple type (a') | 3.60 | 0.138 | 0.51 | FIG. 2 |
| Dimple type (b) | 3.80 | 0.162 | 0.46 | FIG. 1 |

Using a swing robot, the golf balls of Examples 1 and 2 and Comparative Example 1 were hit with a driver at a head speed of 45 m/sec. for measuring a total flight distance. The distance is expressed as a relative value based on a distance of 100 for Comparative Example 1. The results are shown in Table 3.

TABLE 3

| | |
|---|---|
| Example 1 | 104 |
| Example 2 | 103 |
| Comparative Example 1 | 100 |

It is demonstrated that a three-dimensionally appropriate combination and arrangement of a multiplicity of dimples on the surface of a golf ball is effective for improving the aerodynamic behavior of the golf ball. The golf ball exerts excellent flight performance.

Although some preferred embodiments have been described, many modifications and variations may be made thereto in light of the above teachings. It is therefore to be understood that the invention may be practiced otherwise than as specifically described without departing from the scope of the appended claims.

We claim:

1. A golf ball having a multiplicity of dimples of circular plane shape on its surface, wherein the dimples comprise plural types of dimples having different diameters, and the dimples of at least one type having the same diameter have at least two different cross-sectional shapes with different volumes.

2. The golf ball of claim 1 wherein for said dimples of at least one type having at least two different cross-sectional shapes, the difference in $V_0$ between the dimples of different cross-sectional shapes is at least 0.03, provided that $V_0$ is the volume of space in a dimple below a planar surface circumscribed by the edge of the dimple divided by the volume of a cylinder whose base is the planar surface and whose height is the maximum depth of the dimple from this base.

3. The golf ball of claim 1 wherein an average of $V_0$ values of all the dimples on the ball surface is in the range of 0.4 to 0.6, provided that $V_0$ is the volume of space in a dimple below a planar surface circumscribed by the edge of the dimple divided by the volume of a cylinder whose base is the planar surface and whose height is the maximum depth of the dimple from this base.

4. The golf ball of claim 3, wherein an average of $V_0$ is not greater than 0.55.

5. The golf ball of claim 1, wherein all of said dimples have a diameter in the range of 2 to 5 mm and a depth in the range of 0.05 to 0.30 mm.

6. The golf ball of claim 1, wherein dimples of a first type are concave with a constant radius of curvature and said dimples of a second type are concave with a plurality of radii of curvatures.

7. The golf ball of claim 1, wherein dimples of a first type are concave with one constant radius of curvature and dimples of a second type are concave with a second constant radius of curvature.

8. The golf ball of claim 1, wherein said dimples comprise 300 to 500 in total.

9. The golf ball of claim 1, wherein said dimples of said plural types have different diameters and depths.

10. The golf ball of claim 1, wherein said plural types comprise 2 to 5 types of dimples.

* * * * *